US005107578A

United States Patent [19]

Helmstetter

[11] Patent Number: 5,107,578

[45] Date of Patent: Apr. 28, 1992

[54] METHOD TO REPAIR A CHAIR RUNG

[75] Inventor: John G. Helmstetter, Brick, N.J.

[73] Assignee: Core Guard Industries, Inc., Lavallette, N.J.

[21] Appl. No.: 692,625

[22] Filed: Apr. 29, 1991

[51] Int. Cl.[5] ..... B23P 7/04

[52] U.S. Cl. ..... 29/402.06; 29/402.17

[58] Field of Search ..... 29/402.01, 402.06, 402.08, 29/402.09, 402.12, 402.14, 402.17

[56] References Cited

U.S. PATENT DOCUMENTS

| | | | |
|---|---|---|---|
| 3,979,869 | 9/1976 | Beechler | 29/402.06 X |
| 4,034,462 | 7/1977 | Hentges | 29/402.14 |
| 4,531,275 | 7/1985 | Kelly | 29/402.14 |

FOREIGN PATENT DOCUMENTS

| | | | |
|---|---|---|---|
| 3009079 | 9/1980 | Fed. Rep. of Germany | 29/402.09 |

*Primary Examiner*—Timothy V. Eley
*Attorney, Agent, or Firm*—Stephen W. White

[57] ABSTRACT

A novel chair rung repair kit and method to repair a broken chair rung is described. Normally, after a period of time, chair rungs tend to dry out, especially those made from wood. By drilling a small, tapered hole in the longitudinal end of the broken rung, and by inserting a small, tapered and barbed element therein, the rung can be expanded to its normal size and thus repair can be accomplished quickly and easily. The repair is then permanent.

5 Claims, 2 Drawing Sheets

METHOD TO REPAIR A CHAIR RUNG

BACKGROUND OF THE INVENTION

1. Field of the Invention

This invention relates to the field of chairs and more specifically to chair rungs and the like. Still more specifically, this invention relates to a novel and useful system that can be used as a chair rung repair kit.

2. Discussion of the Prior Art

Chairs and other seating arrangements usually comprise a seat which is attached to a plurality of legs in order to provide support therefor. Behind the seat there may be a back to support the user. In between the legs there are usually a plurality of rungs which are used to connect the legs and affix them in a position so that support is provided on a continuing basis. Most of these chairs are made from wood which is a convenient and cost-effective material. The rungs are usually attached to the legs by a dowel-type arrangement. Here, a hole is drilled into the leg and a dowel formed on the end of the rung. Thus, when the rung is forced into the hole on the leg, glue is usually applied to insure a tight and even fit. However, many of these attachments come apart over a period of time as the glue dries out. The rungs must then be removed and re-fitted in order to provide the requisite support. This is a time consuming and costly step and usually requires someone with a chair making skill to provide this repair.

These are a few so-called chair rung repair kits described in the prior art. Most of these involve some kind of re-gluing device. These are not satisfactory since the glue can dry out again and the rung can again come apart from the leg of the chair. A few devices in the prior art furnish some kind of wedge that can be placed within the receiving hole on the chair leg. This system also lacks permanence. Thus, there is a pressing need for convenient chair rung repair kit that can provide an easy, long lasting repair for chair rungs that have come apart from the legs.

SUMMARY OF THE INVENTION

It is an object of this invention to provide a simple and easily used chair rung repair kit that can be used to repair chair rungs that have dried out with time and have come apart from the legs to which they were originally attached, These and yet other objects are achieved in a method to permanently repair a chair rung, said chair rung being attached between two chair legs by insertion in a receptive hole placed in said chair legs, at least one end of said rung having been loosened from said chair legs, wherein a tapered hole is drilled perpendicularly into the loosened end of said chair rung and a small, barbed and tapered element is inserted into said hole so that said chair rung will expand when replaced in operative association with said chair leg.

DETAILS OF THE INVENTION

Figure 1:
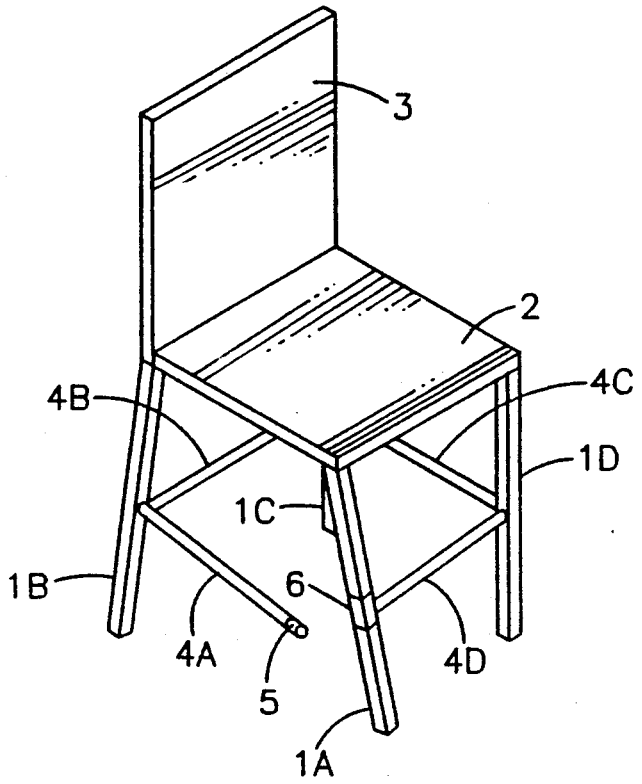
FIG. 1 is a showing of a rung that has been become detached from a typical chair.

Looking now specifically at the drawings which show in detail a process for repairing a typical, wooden chair rung that has become detached from the legs of a chair, FIG. 1 is an overall view of a typical chair which has four legs 1A-1D, a seat 2 and back 3. Between the legs are four rungs 4A-4D. One of these rungs (4A) has become dislodged from leg 1A. This is shown by the fact that rung 4A is drooping and leg 1A has moved outward from its normal position. This dislodgment was probably caused by the fact that the rung itself dried out over time and thus the end 5 of this particular rung shrank causing it to slip from a hole 6 the hole drilled into the leg to receive this end.

Figure 2:
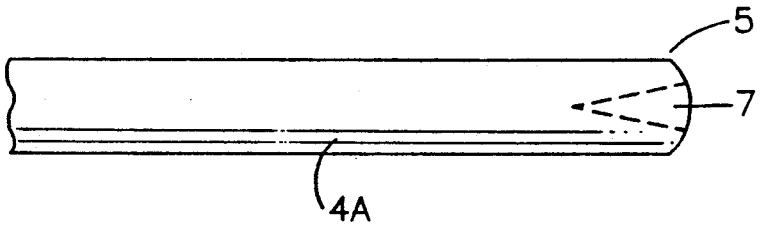
FIG. 2 is an enlarged and detailed showing of the rung from FIG. 1 with a small, tapered hole drilled in the end thereof.

FIG. 2 is a detailed side showing of the rung 4A of FIG. 1 In this viewing, this is shown as a dowel-type rung and the end 5 is shown as having an equivalent diameter as the rest of the body of the rung. However, it is sometimes conventional to taper the end of the rung or reduce the end in order to more easily insert the end into a receptive hole 6 drilled into leg 1A. In this showing, a tapered hole 7 has been drilled into end 5 to begin the repair process of this invention. This hole can be of any desired size and taper length within reason, based only on the size of the rung. This tapered hole can be drilled using any conventional drilling element such as a tapered bit of the right size.

Figure 3:
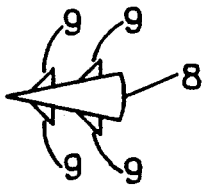
FIG. 3 is a drawing showing a typical small, tapered and barbed element used to insert in the hole of FIG. 2 and thus assist in the repair of the rung.
Figure 4:
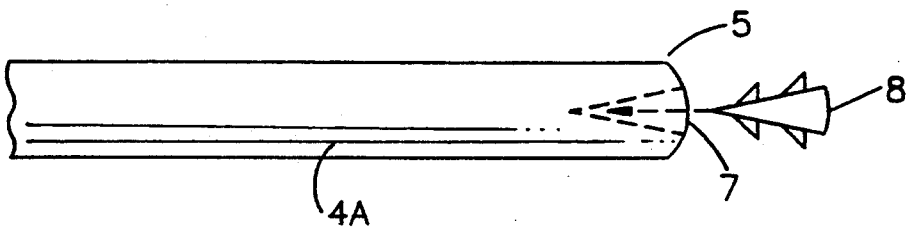
FIG. 4 is a further showing of the rung from FIG. 2 wherein a tapered and barbed device is placed in the hole in order to expand the rung.

FIG. 3 is a side showing of a typical tapered and barbed element or plug 8. Several barbs 9 are shown placed along the tapered body of this element. In this particular embodiment, 4 separate barbs are shown. However, there may be more or less depending on the size of the rung to be repaired and the amount of damage caused by the drying of the rung itself prior to detachment from the leg of the chair. The plug is then inserted into the receptive hole 6 on the chair rung. When this element or plug is placed within the hole, force is applied to insure that the element is inserted fully therein. The barbs are designed so that the plug can be inserted within the hole but impede accidental removal therefrom. A small amount of glue may also be applied to the plug prior to insertion in the tapered hole. All of these insertion details are shown in FIG. 4. When a tapered and barbed element or plug is inserted within the tapered hole drilled in the broken chair rung, the end of the rung will expand to its normal diameter and can thus easily be reinserted into the receptive hole in the chair leg. A small amount of glue can be added to the end of the rung prior to insertion into receptive hole. After drying, the repair is complete and the chair is ready for reuse.

Figure 5:
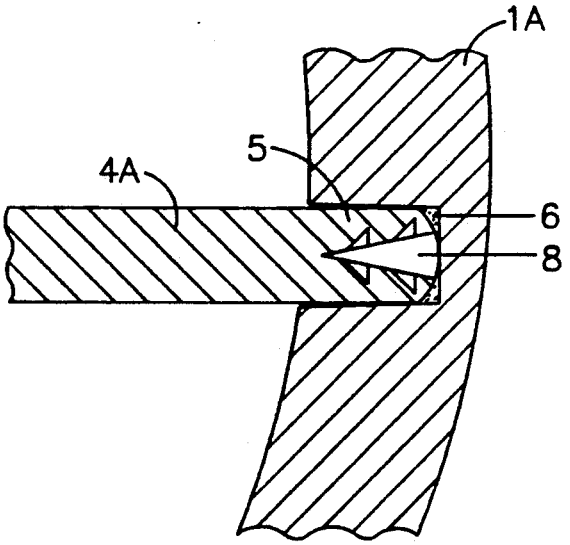
FIG. 5 is an enlarged, detailed showing of a rung of a chair which has been repaired following the teachings of this invention and the process of FIGS. 2-4.

A detailed showing of a repaired chair rung end inserted into a typical chair leg using the details of this invention is shown in FIG. 5. In this showing, all the various parts are numbered according to the descriptions above. Everything is shown in cut-away so as to exemplify the details.

As previously stated, rungs come in many different shapes, sizes and lengths. Within the embodiment shown in the details of the specification, the rung is formed from a typical dowel and is round in nature.

However, there are square, flat and oval shaped rungs, for example. All will fit within the metes and bounds of this invention. The end of the rung may be shaped differently than the body of the rung. For example, it may be tapered down. The receptive hole within the legs of the chair are normally matched to the end of the rung. Glue is normally applied to insure complete bonding occurs between the rung and the leg. Only when the rung becomes dislodged either from shrinkage or normal use thereof, is it requisite to apply the repair process described in this invention. This process is simple and easy to do and requires only the requisite drill to put a tapered hole in the longitudinal end of the broken rung and a tapered and barbed element to insert within this tapered hole. By forcing this element into the tapered hole, the size of the rung is restored and repair can be completed without any other device. This repair is complete and will insure that the rung does not become detached again. None of the prior art systems or devices can make such a statement. All of the prior art elements simply used a device to either re-insert more glue in the receptive hole or placed some sort of devcie on the outside of the rung to insure some enlargement thereof. Complete repair could not then be insured.

I claim:

1. A method to permanently repair a chair rung of a chair, said chair rung comprising two ends, each of said ends being assertably attached between two chair legs by insertion in receptive holes in said chair legs, at least one end of said rung having been loosened from said chair legs, said repair being accomplished by drilling a tapered hole perpendicularly into said loosened end of said chair rung, and by inserting a small barbed and tapered element into said hole so that said chair rung will expand when placed in said receptive hole in operative association with said chair leg.

2. The method of claim 1 wherein said rung is round and said small, barbed and tapered element has at least 4 barbs thereon.

3. The method of claim 2 wherein a small amount of glue is applied to said barb prior to insertion into the tapered hole drilled into the rung.

4. The method of claim 3 wherein a small amount of glue is applied to the end of said chair rung prior to insertion into the receptive hole of said leg.

5. The method of claim 1 wherein said chair is a wooden chair.

* * * * *